United States Patent [19]

Krieger

[11] Patent Number: 5,000,028

[45] Date of Patent: Mar. 19, 1991

[54] WORKPIECE MANIPULATOR ASSEMBLY FOR FORGING MACHINES

[75] Inventor: Wilhelm Krieger, Odenthal, Fed. Rep. of Germany

[73] Assignee: Eumuco Aktiengesellschaft Fur Maschinebau, Fed. Rep. of Germany

[21] Appl. No.: 549,051

[22] Filed: Jul. 6, 1990

[30] Foreign Application Priority Data

Dec. 23, 1989 [DE] Fed. Rep. of Germany ..... 3942942

[51] Int. Cl.[5] ..... B21D 43/02

[52] U.S. Cl. ..... 72/421; 72/422

[58] Field of Search ..... 72/420, 421, 422, 76; 414/751

[56] References Cited

U.S. PATENT DOCUMENTS 3,611,770 10/1971 Kralowetz ..... 72/422

*Primary Examiner*—Robert L. Spruill

*Attorney, Agent, or Firm*—Neil F. Markva

[57] ABSTRACT

A workpiece manipulator assembly for a forging press having a press ram comprises a workpiece rotating mechanism including a rotary drive system for rotating a workpiece in peripheral direction. The rotary drive system is operated by a drive motor running at a preselected constant speed to rotate the workpiece about an axis of rotation. An arresting assembly stops the rotary movement of the workpiece before and during a pressure contact phase for the press ram. The rotary drive system is adapted to rotate a driven worm which produces rotary movement to the workpiece rotating means and is mounted for axial displacement. The arresting assembly includes an axial drive unit for predeterminably controlling axial displacement of the driven worm to effect the arresting of said rotary movement.

10 Claims, 3 Drawing Sheets

WORKPIECE MANIPULATOR ASSEMBLY FOR FORGING MACHINES

FIELD OF THE INVENTION

This invention relates to a workpiece manipulator assembly for forging machines. More particularly, the invention relates to a manipulator assembly for multi-ram forging machines having a plurality of rams radially acting on the forging workpiece which is moved rotatingly in peripheral direction in accordance with the forging sequence. Rotary drive is effected by a motor running at a pre-selected constant speed and acting via a worm drive rotating about the axis of rotation of a manipulator worm shaft.

BACKGROUND OF THE INVENTION

Prior to the forging press pressure contact phase during which the workpiece is engaged by the forging jaws of the pres rams, the rotary movement of the workpiece is arrested and stopped so that the ram jaws may radially act on the workpiece. Generally, such a known forging machine is endowed with a high and invariable number of stroke frequencies primarily used to forge long workpieces.

In such prior art forging machines, the workpiece is moved by manipulators both axially and rotatingly in peripheral direction. The rotary drive of the prior art manipulators is insured by a constantly running electric motor acting via a worm drive on a shaft rotating about an axis of rotation.

Corresponding to the required function, the rotary movement of the shaft about the axis of rotation is arrested during the pressure contact phase by the superimposition of a constant worm drive and a brake-spring system. With the known device, the driven worm is axially displaceable and supported axially via mechanical spring assemblies thus enabling the worm to axially move or be displaced in both directions. During the pressure contact phase, to exclude torque at the manipulator shaft axis due to the spring action, a disk brake is used to brake and correspondingly retain the constant rotary movement of the manipulator shaft axis of the worm wheel to the beginning of the pressure contact phase.

Due to the constant advance of the drive motor, the worm is screwed out against spring tension at the braked worm wheel. Upon termination of the pressure contact phase, the brake is disengaged so that the worm is reset again via the tensioned spring. An increased speed is formed over the contact speed at the worm wheel and at the manipulator tongs accordingly. The rotary angle lag resulting from the braking is recovered again.

In the course of the worm resetting movement and in functional relationship with the additionally accelerated masses, one does not only reach the center position due to resetting, but the system swings also into the opposite spring set and partly back again. Prior to the beginning of the new pressure contact time of the next working cycle, the brake is engaged again.

In case of the oscillatory system, spring tension, mass forces and speeds are in a direct physical relationship. A regular operation of the known mechanical brake-spring system may be only insured if the structurally determined parameters are maintained. Already with different ways of machining (roughing and refining), the relationship between contact time and idle time forms a variable resulting in different parameters for the oscillatory brake-spring system.

It is imperative for the oscillatory brake-spring system to be bound to a fixed stroke frequency of the forging machine. Since the rotary mass is different in response to the workpiece size, a mass change is accompanied by a disadvantageous effect on the known brake-spring system. In addition, friction and attenuation are changing in the current operation and wear is caused by the brake required in the rotary drive. Because the brake paths of a friction brake are not constant, the machine function is affected accordingly. Thus, with the known brakespring system the axial displacement of the worm shaft has control but is fixedly determined by the mechanical structure of the system itself. Such known system is not capable of being predeterminable controllable or adaptable to a variable forging sequence.

SUMMARY OF THE INVENTION

The primary object of the invention is to obviate the disadvantages of the known oscillatory brake-spring system for adjusting the driven worm in axial displacement. The invention provides an active and positive influence on the axial displaceability of the driven worm in place of the known oscillatory mechanical system. According to the invention, the manipulator assembly of the design mentioned at the outset hereof includes a predeterminably controllable and superimposed drive mechanism axially acting on the worm of the worm drive at the same time the worm is rotated at a constant speed.

According to another feature of the invention, the superimposed drive mechanism comprises a hydraulically operated piston-cylinder unit disposed at the free end of the worm shaft. The piston is connected to a worm shaft for axially displacement with the worm shaft while the cylinder of the piston-cylinder unit is fixedly disposed with respect to the manipulator assembly.

The workpiece manipulator assembly of the present invention is for a forging press having a press ram. The manipulator assembly comprises means for rotating the workpiece in peripheral direction. Rotating means include rotary drive means operated by motor means running at a preselected constant speed. Arresting means is provided for stopping the rotary movement of the rotary drive means before and during a pressure contact phase for the press ram. The rotary drive means includes a driven worm disposed on a worm shaft for axial displacement with the worm shaft. The arresting means includes a superimposed drive mechanism having axial drive means which predeterminably control the axial displacement of the worm shaft carrying the rotatably driven worm.

The predeterminably controllable superimposed drive mechanism controls the axial movement of the worm shaft while the worm is rotated via a drive motor running at a preselected constant speed. Thus, coordinated axial movement characteristics are effectively imparted to the axial movement of the rotating worm. Due to such an active control of the system, the rotation of the manipulator shaft about the its axis of rotation is arrested just prior to reaching the pressure contact phase of the forging ram. Furthermore, after the ram pressure contact phase, the active control of the axial drive mechanism provides additional acceleration and speed in recovering the lag formed during the pressure contact phase back to the speed required for the next working cycle.

As another advantage of the invention, the forging machine may be operated with various stroke frequencies. Accordingly, with the invention, the stoppage times of rotation for the manipulator shaft about its axis of rotation may be adapted to the corresponding pressure contact times of the forging press ram. Consequently, it is now possible for the manipulator shaft rotating about the axis of rotation to move in harmony in a predetermined controlled manner. Above all, acceleration and delay as well as stoppage during the pressure contact of the forging press ram may be performed in harmony without using other mechanical units such as brakes, springs, damping elements and the like. Mechanical construction expenditure is reduced and operability is increased.

In accordance with the invention, the hydraulic piston-cylinder unit is of the servo-control type. Due to the servo control, predeterminable movement characteristics for the axial movement of the worm may be produced. In a specific embodiment, a servo-control unit uses feedback information about the axial position of the piston member for comparing the actual and desired values to provide the novel control system of the invention.

BRIEF DESCRIPTION OF THE DRAWINGS

Other objects of this invention will appear in the following description and appended claims, reference being made to the accompanying drawings forming a part of the specification wherein like reference characters designate corresponding parts in the several views

DETAILED DESCRIPTION OF THE INVENTION

Figure 1:
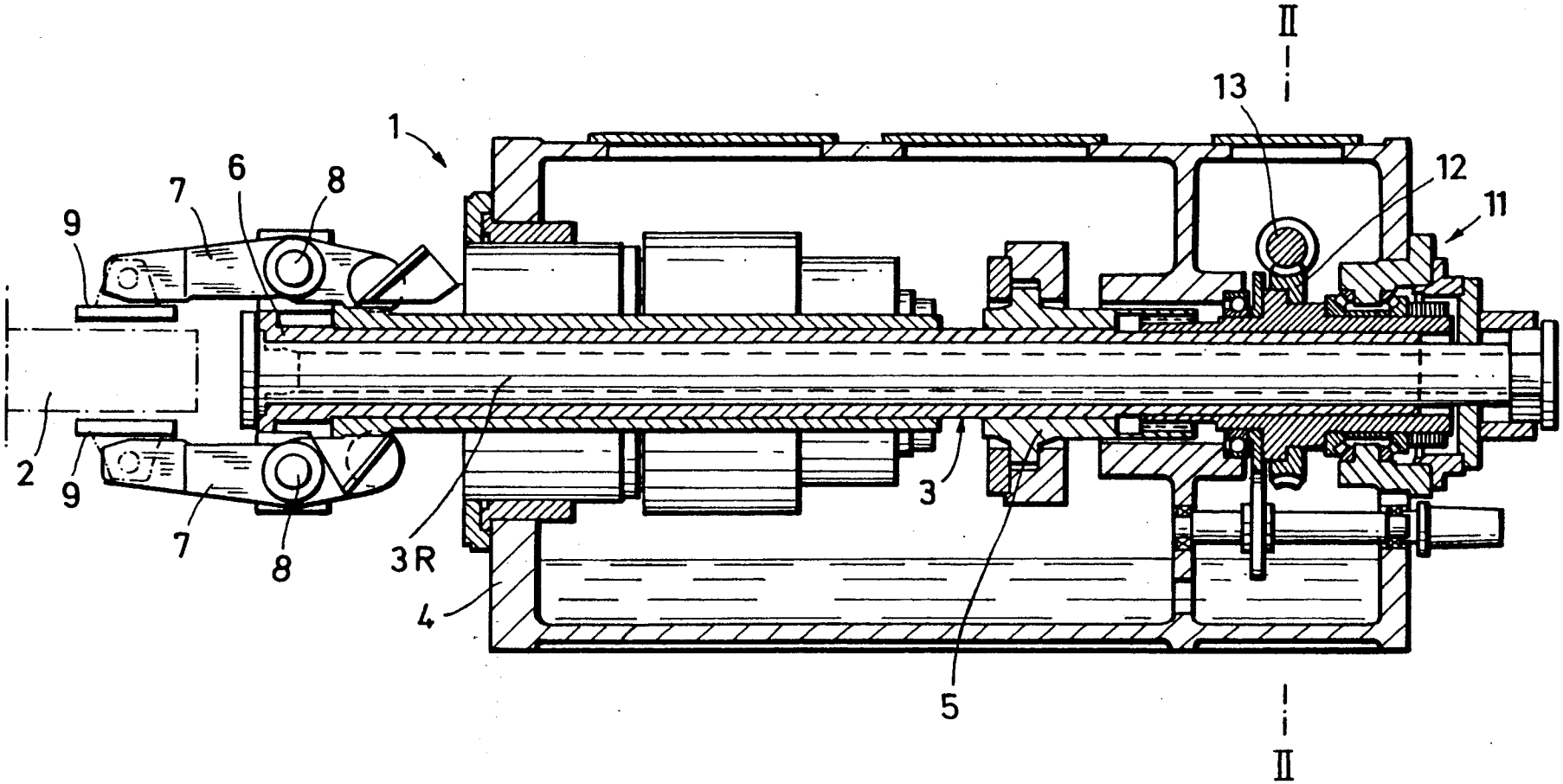
FIG. 1 is a longitudinal sectional view of a manipulator assembly of the invention for moving the workpiece axially and rotatingly in peripheral direction.

FIG. 1 shows workpiece 2 moved axially and rotatingly in peripheral direction by the manipulator assembly, generally designated 1, in accordance with the forging sequence. Rotation of workpiece 2 is performed by a central manipulator shaft 3 disposed in manipulator housing 4. The rotary movement of workpiece 2 is initiated via hub 5 fixedly connected to central shaft 3 having a projecting collar 6 at its free front end.

Figure 2:
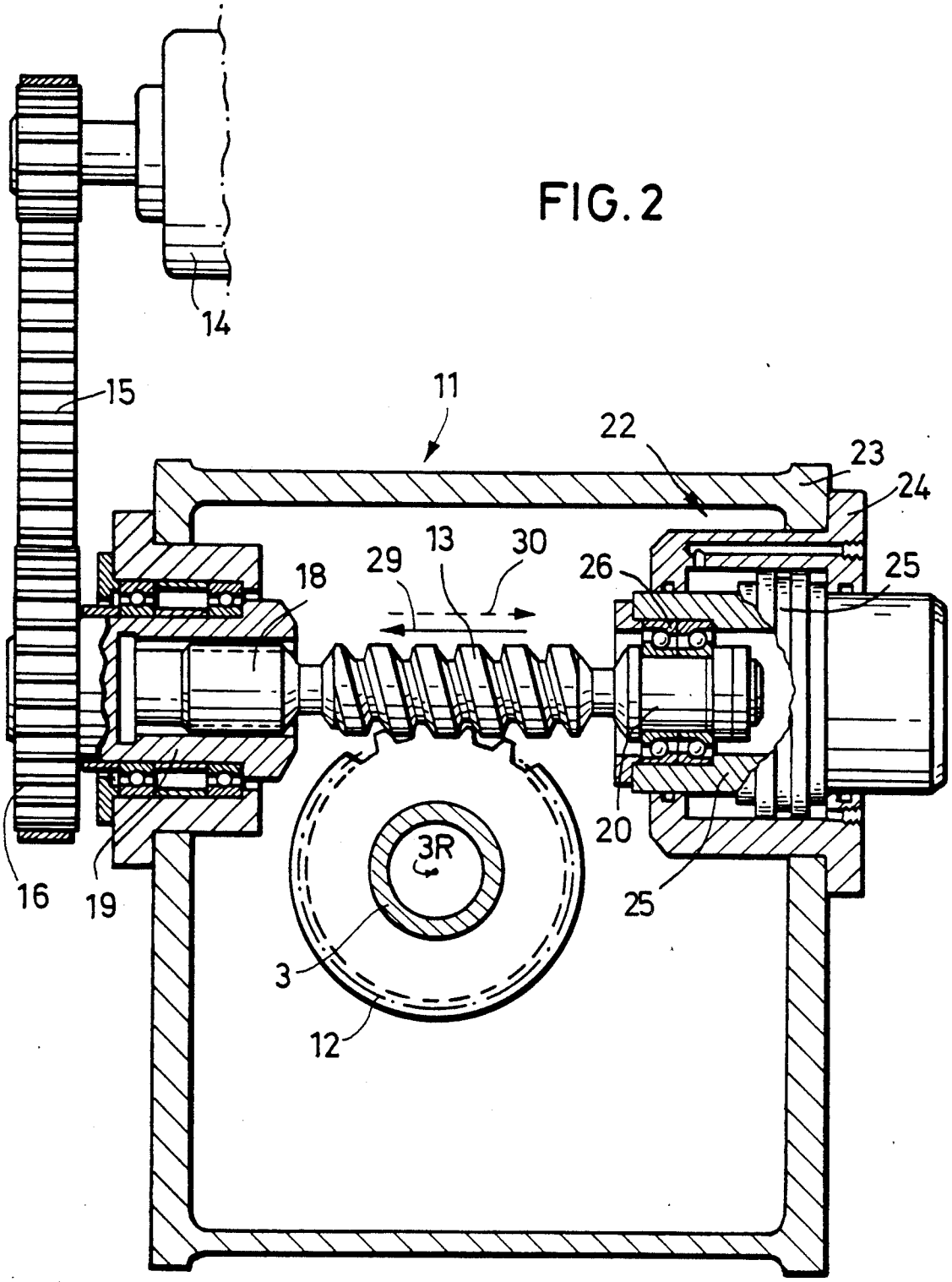
FIG. 2 is a fragmentary sectional view along line II—II of FIG. 1 of the manipulator assembly of the invention and showing a fragmentary elevational view of the rotary drive means.

A specific number of tong levers 7 are disposed on the free front end of shaft 3 and are pivotable about pins 8. Levers 7 carry tong jaws 9 at their free end to engage workpiece 2. The rotational and axial control of manipulator shaft 3 is dictated by the forging sequence. That is, the degree of rotation and longitudinal movement of workpiece 2, depends upon the forging sequence required to produce the desired structure for workpiece 2. Motor 14, shown in FIG. 2, constantly runs at a preselected speed for effecting the rotary drive of central manipulator shaft 3. Motor 14 acts via a worm drive, generally designated 11, on shaft 3. Worm drive 11 includes worm 13 and worm wheel 12 which is nonrotatingly connected to shaft 3 which rotates about its axis of rotation 3R. Worm 13 engages worm wheel 12 and worm shaft carrying worm 13 is adapted to be axially displaceable. Rotary drive from motor 14 is imparted via worm 13 through worm wheel 12 to manipulator shaft 3 rotating about the manipulator axis of rotation 3R. Drive motor 14 operates to rotate worm 13 by a transmission mechanism comprising toothed belt 15 and belt pulled 16.

One shaft end 18 of worm 13 engages a rotatably mounted bushing 19 which is rigidly connected to belt pulley 16. Shaft end 18 is slidable longitudinally within bushing 19, but is shaped or keyed to rotate with bushing 19. The other shaft end 20 of axially displaceable worm 13 is mounted to a hydraulically operating piston-cylinder unit 22. Piston 25 is axially displaceable in cylinder 24 and hydraulically movable within cylinder 24 which is fixedly mounted to a frame or housing wall 23. Piston 25 is axially connected to shaft end 20 so that when piston 25 moves within cylinder 24, worm 13 moves axially accordingly. At the same time, worm shaft ends 18 and 20 are freely rotatable due to the bearings mounted to bushing 19 and piston 25 as shown. Thus, worm 13 is supported to be axially displaceable while being freely rotatable with worm shaft ends 18 and 20.

In this particular embodiment, piston-cylinder unit 22 hydraulically operates with a servo-control design. Thus, the servo-control mechanism, generally designated 28, effects predeterminable movement characteristics to piston 25 thereby generating a predetermined axial movement to worm 13. The servo-control mechanism 28 enables the axial displacement of worm 13 to be influenced with feedback information by comparing actual and desired values related to the position of piston 25 in cylinder 24. Thus, prior to reaching the pressure contact phase by the rams of the forging press, the rotation of manipulator shaft 3 about manipulator axis of rotation 3R is arrested through the predeterminable control of piston 25 within cylinder 24.

In this case, the driven, axially movable worm shaft 13 is displaced at a corresponding constant speed in the arrow direction 29 so that worm 13 is screwed out of worm wheel 12, while worm wheel 12 and the rotation of manipulator shaft 3 about axis 3R are stopped in spite of rotary drive means 14 to 18 remaining constant. Thus, the axial displacement of worm shaft 13 moves at a speed sufficient to compensate for the continued rotation of the worm 13 so that the effect is to stop the rotation of worm wheel 12 and manipulator shaft 3 about the axis of rotation 3R.

Upon determination of the pressure contact phase by the forging rams (not shown), the axially displaceable worm shaft 13 is reset in arrow direction 30 by servo-control mechanism 28. Thus, the rotation of shaft 3 about the axis of rotation 3R is accelerated in addition to the constantly driving run of the rotary drive means including drive motor 14 and transmission belt 15 to recover the formed lag in rotation up to the next working cycle. By the programmable control means of the superimposed drive type acting additionally on the axial displacement of worm shaft 13, the axial cinetics of the rotatable worm shaft 13 are actively engaged.

By simple means, the forging press machine may operate at various stroke frequencies accordingly. The stoppage times for rotation of manipulator shaft 3 about rotational axis 3R may be adapted predeterminably in accordance with the pressure contact times of the forging press rams. Other mechanical means such as brakes, springs, damping elements and the like are unnecessary. The mechanical expenditure is considerably reduced and operability of the total installation is increased.

Figure 3:
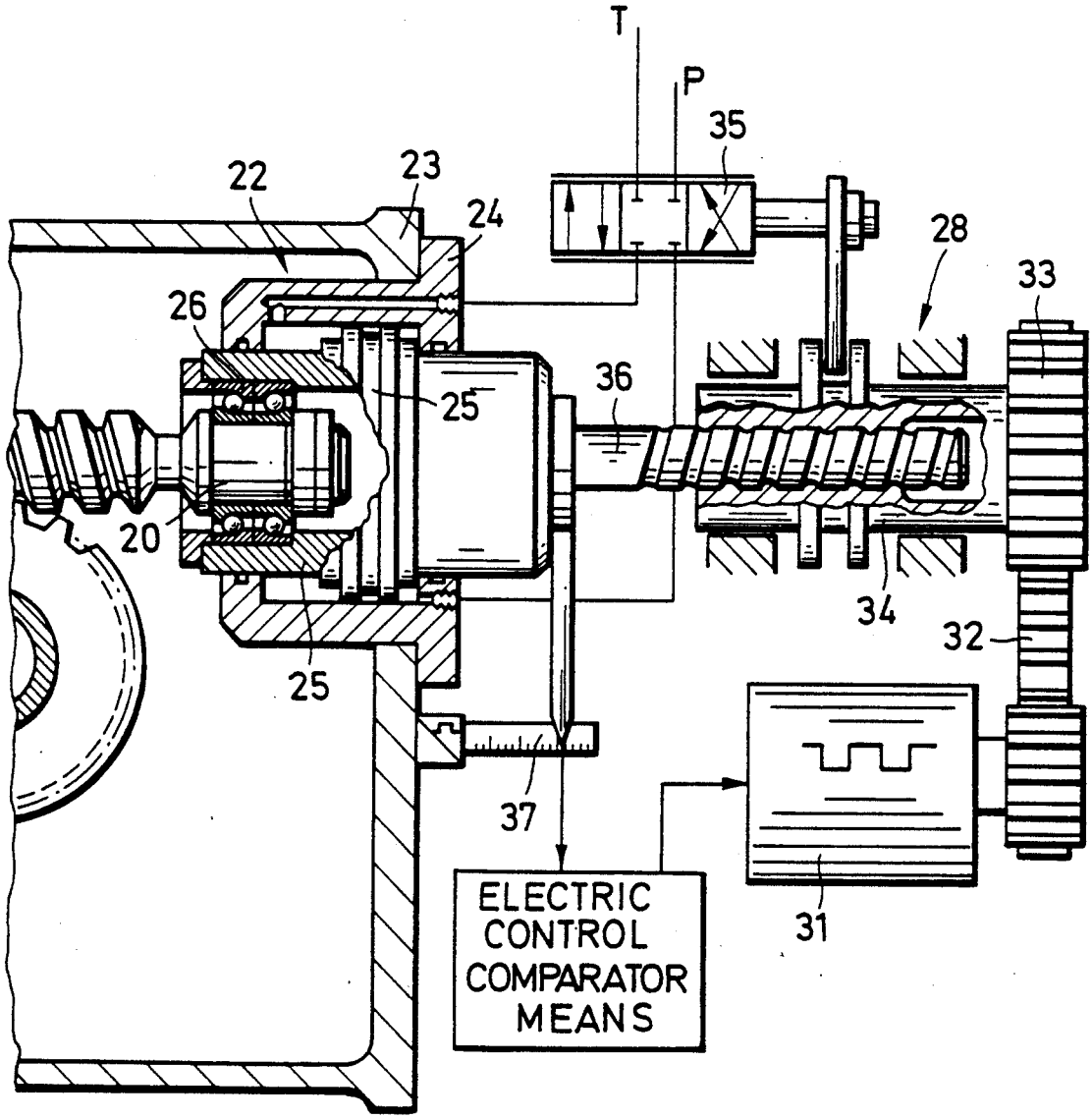
FIG. 3 is a fragmentary schematic view of a servo control unit for controlling the axial movement of the worm drive of the manipulator assembly.

FIG. 3 shows a specific embodiment of a servo-control mechanism 28 whereby the piston-cylinder unit 22 is controlled by a servo-hydraulic valve mechanism 28. Stepping motor 31 operates a belt pulley 33 via a transmission member comprising a toothed belt 32. Stepping motor 31 thereby acts on a spindle-nut system 34 of servo-hydraulic valve mechanism 28. The desired value input is fed rotatingly with a minimum power by stepping motor 31. The rotating movement of the input shaft is converted into a linear movement so that the movement of valve 35 opens oppositely to the desired direction of movement of piston 25.

Because thread spindle 36 is nonrotatingly connected to piston 25, valve 35 is in direct linear communication with piston 25 so that by the closed mechanical control loop, the actual position of piston 25 acts on valve 35. Upon reaching the predetermined desired value, valve 35 will be closed again. To control the position of piston 25, the actual value of the position of piston 25 within cylinder 24 is scanned via a separate measuring path system 37 and, in the electrical control means, it is compared to the predetermined desired value. Thus, the servo-control means constitutes the programmable control means for effecting axial movement of driven worm 13.

While the workpiece manipulator assembly for forging machines has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention what is claimed is:

1. A workpiece manipulator assembly for a forging press having a press ram, said assembly comprising (a) workpiece rotating means including rotary drive means for rotating a workpiece in peripheral direction, (b) said rotary drive means being operated by motor means running at a preselected constant speed to rotate the rotary drive means about an axis of rotation, (c) means for arresting the rotary movement of the workpiece before and during a pressure contact phase for the press ram, (d) said rotary drive means being adapted to rotate a driven worm which produces rotary movement to the workpiece rotating means and is mounted for axial displacement, and (e) said arresting means including axial drive means for predeterminably controlling axial displacement of the driven worm to effect the arresting of said rotary movement.

2. An assembly as defined in claim 1 wherein the forging machine has a plurality of press rams acting radially on a workpiece in the forging press and in accordance with a forging sequence, drive means being effective to predeterminably control the axial displacement of the driven worm to effect the arresting of said rotary movement during the contact phase for each of the press rams.

3. An assembly as defined in claim 1 wherein the driven worm is disposed along a worm shaft having two free ends, said axial drive means includes a hydraulically operated piston-cylinder unit having a piston member axially displaceable within a cylinder, said piston member being connected to one free end of the axially displaceable worm shaft for axial displacement with the driven worm, and the cylinder is fixedly mounted with respect to the manipulator assembly.

4. An assembly as defined in claim 3 wherein displaceable worm shaft is mounted to rotate the driven worm about the axis of rotation while the piston member moves axially with the worm shaft.

5. An assembly as defined in claim 3 wherein the hydraulic piston-cylinder unit includes a servo-control means to produce predeterminable movement characteristics for the axial movement of the worm shaft carrying the driven worm.

6. An assembly as defined in claim 5 wherein the servo-control means operates in cooperation with feedback information by comparing actual movement of the axial shaft to the desired amount of movement for the axial shaft.

7. An assembly as defined in claim 4 wherein the servo-control means includes a stepping motor and a hydraulic valve for controlling a flow of hydraulic fluid to axially move the piston member within the cylinder, the stepping motor having a rotatable input shaft connected to means for converting rotating movement of the input shaft into linear movement.

8. An assembly as defined in claim 7 wherein a threaded spindle is nonrotatingly connected to the piston member to be axially displaceable with the piston member, and the rotating movement converting means includes a spindle-nut mechanism whereby the axially displaceable threaded spindle threadingly engages nut means to thereby be in rotational relationship with the threaded spindle causing relative axial movement between the spindle and nut means.

9. An assembly as defined in claim 8 wherein the stepping motor is rotatingly connected to the nut means to cause the nut means to move linearly in axial displacement with respect to the threaded spindle.

10. An assembly as defined in claim 9 wherein the hydraulic valve is responsive to the linear movement of the nut means to actuate the hydraulic valve for controlling the flow of hydraulic fluid.

* * * * *